US011640791B2

(12) United States Patent
Ha et al.

(10) Patent No.: US 11,640,791 B2
(45) Date of Patent: May 2, 2023

(54) PIXEL AND DISPLAY APPARATUS HAVING THE SAME

(71) Applicant: Samsung Display Co., Ltd., Yongin-si (KR)

(72) Inventors: Tae-Seok Ha, Hwaseong-si (KR); Kyoungsoo Kim, Suwon-si (KR); Kyu-Jin Park, Hwaseong-si (KR); Sung-Jae Park, Seongnam-si (KR); Seung-Woon Shin, Asan-si (KR); Woon-Rok Jang, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/665,853

(22) Filed: Feb. 7, 2022

(65) Prior Publication Data

US 2022/0328001 A1 Oct. 13, 2022

(30) Foreign Application Priority Data

Apr. 8, 2021 (KR) ..... 10-2021-0045696

(51) Int. Cl.
*G09G 3/3233* (2016.01)

(52) U.S. Cl.
CPC ..... *G09G 3/3233* (2013.01); *G09G 2310/061* (2013.01); *G09G 2310/08* (2013.01); *G09G 2320/0233* (2013.01)

(58) Field of Classification Search
CPC ..... G09G 3/3233; G09G 2310/061; G09G 2310/08; G09G 2320/0233
See application file for complete search history.

(56) References Cited

U.S. PATENT DOCUMENTS

2006/0022909 A1* 2/2006 Kwak ..... G09G 3/3233 345/76
2006/0076550 A1* 4/2006 Kwak ..... G09G 3/2003 257/13
2006/0077194 A1* 4/2006 Jeong ..... G09G 3/3233 345/204
2009/0135111 A1* 5/2009 Yamamoto ..... G09G 3/3233 345/76
2009/0315870 A1* 12/2009 Goh ..... G09G 3/3233 345/208
2013/0201172 A1* 8/2013 Jeong ..... G09G 3/3266 345/82
2014/0354704 A1* 12/2014 Pak ..... G09G 3/2077 345/82
2021/0125555 A1* 4/2021 Yamamoto ..... G09G 3/2003

FOREIGN PATENT DOCUMENTS

KR 1020170042541 A 4/2017
KR 101958030 B1 3/2019
KR 1020200036588 A 4/2020

* cited by examiner

*Primary Examiner* — Jeff Piziali
(74) *Attorney, Agent, or Firm* — Cantor Colburn LLP

(57) ABSTRACT

A pixel includes a capacitor including a first electrode and a second electrode, a first transistor which generates a driving current, a second transistor which applies a data voltage to the first electrode of the capacitor, a third transistor which applies an initialization voltage to the second electrode of the capacitor, a fourth transistor which generates a leakage current in response to a dimming signal, and a light emitting element which emits light based on a residual driving current, where the residual driving current is obtained by subtracting the leakage current from the driving current.

18 Claims, 8 Drawing Sheets

PIXEL AND DISPLAY APPARATUS HAVING THE SAME

This application claims priority to Korean Patent Application No. 10-2021-0045696, filed on Apr. 8, 2021, and all the benefits accruing therefrom under 35 U.S.C. § 119, the content of which in its entirety is herein incorporated by reference.

BACKGROUND

1. Field

Embodiments of the invention relate to a pixel and a display apparatus including the pixel. More particularly, embodiments of the invention relate to a display apparatus operating in a variable frame period and a pixel included the display apparatus.

2. Description of the Related Art

Generally, a display apparatus displays (or refreshes) image at a constant frame frequency. However, a frame frequency of rendering performed by a host processor, e.g. a graphic processing unit ("GPU"), may not match a frame frequency of the display apparatus. In particular, when the host processor provides input image data for game image generated by a complex rendering to the display apparatus, such a mismatch of a frame frequency may be intensified. Also, a tearing phenomenon in which a boundary line is generated in image displayed on the display apparatus may be caused by the mismatch of the frame frequency.

To prevent such the tearing phenomenon, a technology in which a host processor provides input image data to a display apparatus at a variable frame frequency by changing a blank period per frame has been developed. The display apparatus may prevent the tearing phenomenon by displaying (or refreshing) image in synchronization with variable frame frequency.

SUMMARY

In a case where an image is displayed on a display apparatus in synchronization with variable frame frequency, when a low grayscale image is displayed on a display panel, a luminance difference may be generated between a variable frame period and a basic frame period by a delay of an on-slew of a light emitting element, and thus a flicker may occur.

Embodiments of the invention provide a display apparatus which reduces or prevents a luminance difference between a basic frame period and a variable frame period.

Embodiments of the invention also provide a pixel which adjusts reduces or prevents a luminance difference between a basic frame period and a variable frame period.

In an embodiment of a pixel according to the invention, the pixel includes a capacitor, a first transistor, a second transistor, a third transistor, a forth transistor, and a light emitting element. In such an embodiment, the capacitor includes a first electrode and a second electrode. In such an embodiment, the first transistor generates a driving current, the second transistor applies a data voltage to the first electrode of the capacitor, the third transistor applies an initialization voltage to the second electrode of the capacitor, and the fourth transistor generates a leakage current in response to a dimming signal. In such an embodiment, the light emitting element emits light based on a residual driving current, and the residual driving current is obtained by subtracting the leakage current from the driving current.

In an embodiment, the pixel may further include a resistance element connected to the fourth transistor and having a fixed resistance.

In an embodiment, a sum of a turn-on resistance of the fourth transistor and the fixed resistance of the resistance element may be greater than a saturation resistance of the light emitting element.

In an embodiment, the dimming signal may be not activated in a basic frame period, and the dimming signal may be activated in a variable frame period.

In an embodiment, the dimming signal in the variable frame period may be activated at a same timing as an activation timing of a gate signal in the basic frame period.

In an embodiment, an activation of the dimming signal may be started in a blank period of the variable frame period.

In an embodiment, a length of an activation period of the dimming signal may be determined by a characteristic of the pixel.

In an embodiment, a voltage level of the dimming signal may be gradually changed during an activation period of the dimming signal.

In an embodiment, the voltage level of the dimming signal may be increased with time during the activation period of the dimming signal.

In an embodiment of a display apparatus according to the invention, the display apparatus includes a display panel, and a display panel driver. In such an embodiment, the display panel includes a plurality of pixels, and the display panel driver applies a gate signal and a dimming signal to the pixels. In such an embodiment, each of the pixels includes a capacitor, a first transistor, a second transistor, a third transistor, a forth transistor, and a light emitting element. In such an embodiment, the capacitor includes a first electrode and a second electrode. In such an embodiment, the first transistor generates a driving current, the second transistor applies a data voltage to the first electrode of the capacitor, the third transistor applies an initialization voltage to the second electrode of the capacitor, and the fourth transistor generates a leakage current in response to the dimming signal. In such an embodiment, the light emitting element emits light based on a residual driving current and the residual driving current is obtained by subtracting the leakage current from the driving current.

In an embodiment, each of the pixels may further include a resistance element connected to the fourth transistor and having a fixed resistance.

In an embodiment, a sum of a turn-on resistance of the fourth transistor and the fixed resistance of the resistance element may be greater than a saturation resistance of the light emitting element.

In an embodiment, the dimming signal may be not activated in a basic frame period, and the dimming signal may be activated in a variable frame period.

In an embodiment, the dimming signal in the variable frame period may be activated at a same timing as an activation timing of the gate signal in the basic frame period.

In an embodiment, a length of an activation period of the dimming signal may be determined by a characteristic of the pixel.

In an embodiment, a voltage level of the dimming signal may be gradually changed during an activation period of the dimming signal.

In an embodiment, the voltage level of the dimming signal may be increased with time during the activation period of the dimming signal.

In an embodiment, an activation of the dimming signal may be started in a blank period of the variable frame period.

In an embodiment, the display panel driver may sequentially apply the dimming signal to the pixels on a row-by-row basis.

In an embodiment, the display panel driver may simultaneously apply the dimming signal to all of the pixels.

In embodiments of the invention, the pixel and the display apparatus including the pixel may prevent a luminance difference generated by a difference of a length of a blank period between a variable frame period and a basic frame period by controlling a leakage current of a driving current flowing into the light emitting element in the variable frame period, thereby improving image quality.

BRIEF DESCRIPTION OF THE DRAWINGS

The above and other features of the invention will become more apparent by describing in detailed embodiments thereof with reference to the accompanying drawings, in which.

DETAILED DESCRIPTION

Figure 1:
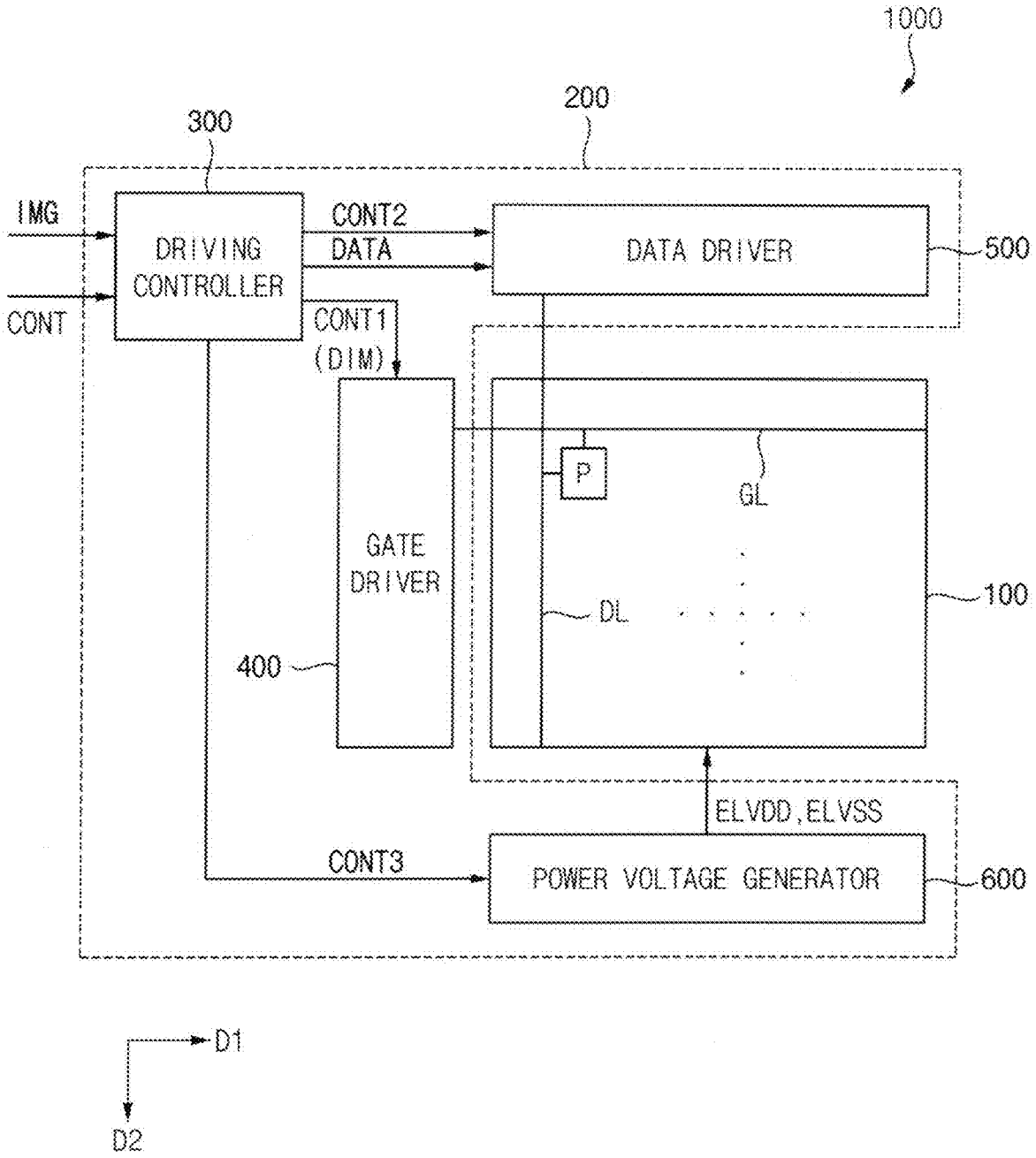
FIG. 1 is a block diagram illustrating a display apparatus according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the invention will be described in detail with reference to the accompanying drawings.

FIG. 1 is a block diagram illustrating a display apparatus according to an embodiment of the invention.

Referring to FIG. 1, an embodiment of the display apparatus 1000 may include a display panel 100 and a display panel driver 200. The display panel driver 200 may include a driving controller 300, a gate driver 400, and a data driver 500. The display panel driver 200 may further include a power voltage generator 600.

In an embodiment, at least two selected from the driving controller 300, the gate driver 400, the data driver 500, and the power voltage generator 600 may be integrated into a single chip.

In an embodiment, the display panel 100 may be an organic light emitting diode display panel including an organic light emitting diode. In one embodiment, for example, the display panel 100 may be a quantum-dot organic light emitting diode display panel including an organic light emitting diode and a quantum-dot color filter. Alternatively, the display panel 100 may be a liquid crystal display panel including a liquid crystal layer.

The display panel 100 may include a plurality of gate lines GL, a plurality of data lines DL and a plurality of pixels P electrically connected to the gate lines GL and the data lines DL. The gate lines GL may extend in a first direction D1 and the data lines DL may extend in a second direction D2 crossing the first direction D1.

The driving controller 300 may receive input image data IMG and an input control signal CONT from a host processor, e.g. graphic processing unit ("GPU"). In one embodiment, for example, the input image data IMG may include red image data, green image data and blue image data. The input image data IMG may further include white image data. In an alternative embodiment, the input image data IMG may include magenta image data, yellow image data and cyan image data. In one embodiment, for example, the input control signal CONT may include a master clock signal and a data enable signal. The input control signal CONT may further include a vertical synchronizing signal and a horizontal synchronizing signal.

The driving controller 300 may generate a first control signal CONT1, a second control signal CONT2, a third control signal CONT3, and a data signal DATA based on the input image data IMG and the input control signal CONT.

The driving controller 300 may generate the first control signal CONT1 for controlling an operation of the gate driver 400 based on the input control signal CONT, and outputs the first control signal CONT1 to the gate driver 400. The first control signal CONT1 may include a vertical start signal, a gate clock signal, and a dimming signal DIM (or a driving current leakage control signal).

The driving controller 300 may generate the second control signal CONT2 for controlling an operation of the data driver 500 based on the input control signal CONT, and output the second control signal CONT2 to the data driver 500. The second control signal CONT2 may include a horizontal start signal and a load signal.

The driving controller 300 may generate the data signal DATA based on the input image data IMG. The driving controller 300 may output the data signal DATA to the data driver 500.

The gate driver 400 generates gate signals SC and SS (see in FIG. 2) for driving the gate lines GL in response to the first control signal CONT1 received from the driving controller 300. The gate signals SC and SS may include a first gate signal SC and a second gate signal SS. The gate driver 400 may output the gate signals SC and SS and the dimming signal DIM to the gate lines GL. In one embodiment, for example, each of the gate lines GL may include a plurality of lines corresponding to the gate signals SC and SS and the dimming signal DIM. In one embodiment, for example, the gate driver 400 may sequentially output the gate signals SC and SS to the gate lines GL. The dimming signal DIM will be described later in greater detail.

The data driver 500 may receive the second control signal CONT2 and the data signal DATA from the driving controller 300. The data driver 500 may convert the image data into a data voltage DV (see in FIG. 2) having an analog type. The data driver 500 may output the data voltage DV to the data lines DL.

The power voltage generator 600 may generate power voltages ELVDD and ELVSS and provide the power voltages ELVDD and ELVSS to the display panel 100. In one embodiment, for example, the power voltage generator 600 may apply a first power voltage ELVDD and a second power voltage ELVSS to the pixel P including a light emitting element EL (see in FIG. 2). In one embodiment, for example, the first power voltage ELVDD may be a high power voltage, and the second power voltage ELVSS may be a low power voltage.

The power voltage generator 600 may receive a third control signal CONT3 for adjusting the level of the power voltages ELVDD and ELVSS from the driving controller 300. The power voltage generator 600 may generate the power voltages ELVDD and ELVSS based on the third control signal CONT3.

Figure 2:
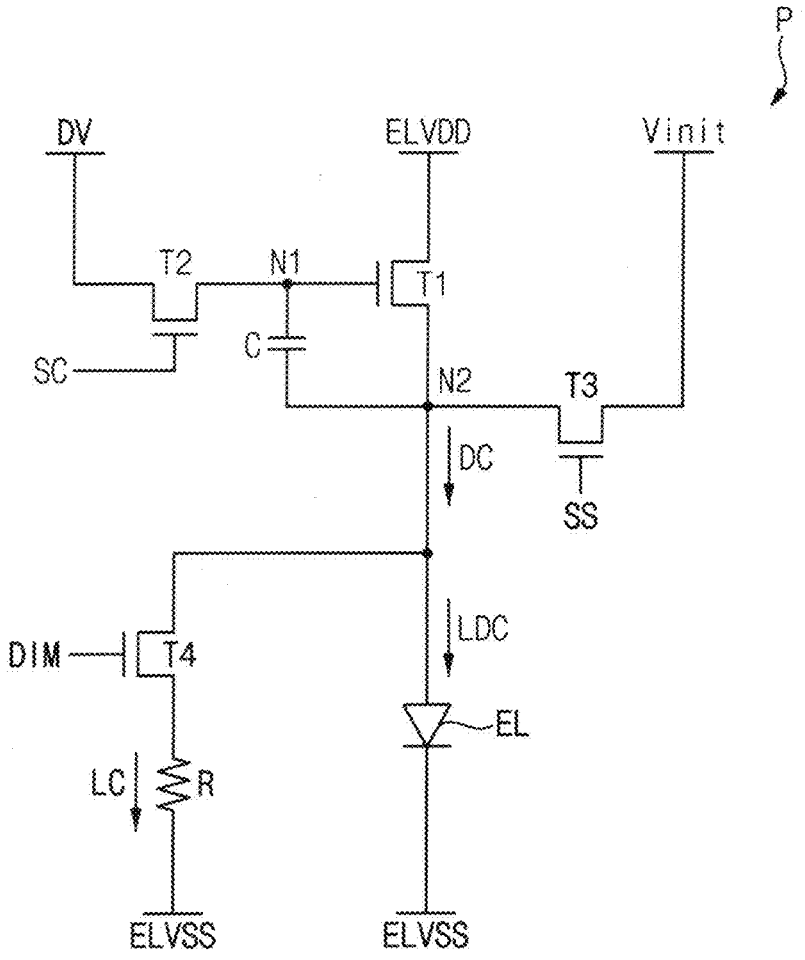
FIG. 2 is a circuit diagram illustrating an embodiment of a pixel of the display apparatus of FIG. 1.

FIG. 2 is a circuit diagram illustrating an embodiment of a pixel of the display apparatus of FIG. 1.

Referring to FIG. 2, the pixel P may include a capacitor C including a first electrode N1 and a second electrode N2. The pixel P may further include a first transistor T1 that generates a driving current DC. The pixel P may include a second transistor T2 that applies the data voltage DV to the first electrode N1 of the capacitor C. The pixel P may further include a third transistor T3 that applies the initialization voltage Vinit to the second electrode N2 of the capacitor C. The pixel P may further include a fourth transistor T4 that leaks the driving current DC (or generates a leakage current LC) in response to the dimming signal DIM. The pixel P may further include the light emitting element EL that emits light based on a residual driving current LDC generated by excluding (or subtracting) the leakage current LC leaked by the fourth transistor T4 from the driving current DC generated by the first transistor T1.

Figure 3:
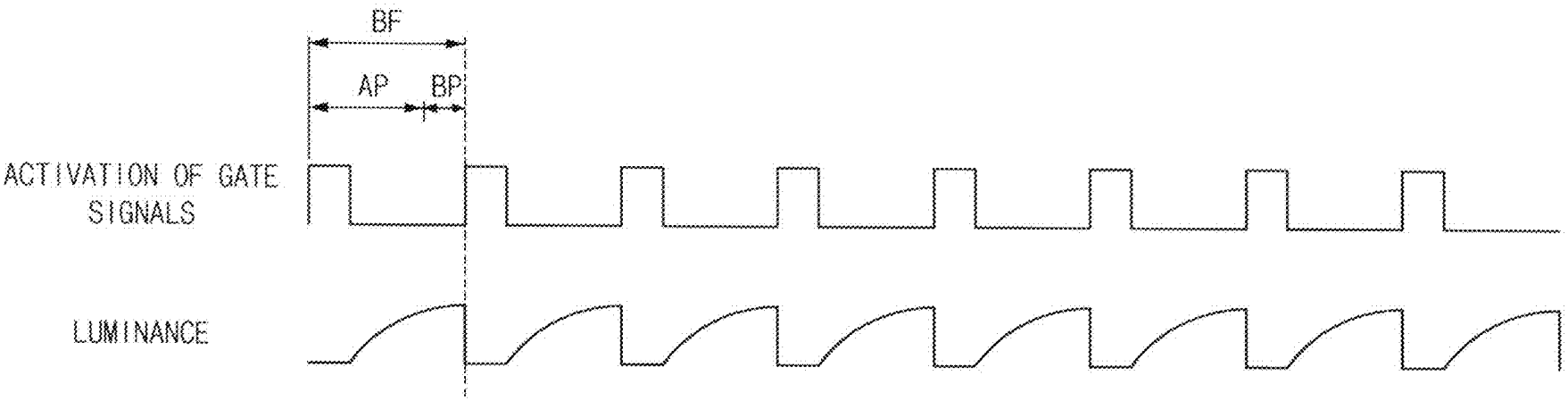
FIG. 3 is a diagram illustrating an embodiment in which the display apparatus of FIG. 1 is driven in a basic frame period.

One frame may be divided into an active period AP and a blank period BP (shown in FIG. 3). In the active period AP, the data voltage DV may be applied to the pixel P. In the active period AP, the gate signals SC and SS may be activated. In the active period AP, the gate signals SC and SS may be sequentially activated in each of the gate lines GL.

In the active period AP, a first gate signal SC and a second gate signal SS may be activated. When the first gate signal SC is activated, the second transistor T2 may be turned on. When the second transistor T2 is turned on, the data voltage DV may be applied to the first electrode N1. When the second gate signal SS is activated, the third transistor T3 may be turned on. When the third transistor T3 is turned on, the initialization voltage Vinit may be applied to the second electrode N2. The initialization voltage Vinit may be maintained in the second electrode N2 during an activation period of the second gate signal SS. When the initialization voltage Vinit is applied to the anode electrode of the light emitting element EL, the light emitting element EL may not emit light. When the first gate signal SC and the second gate signal SS are deactivated, the light emitting element EL may emit light based on the residual driving current LDC. In the blank period BP, the first gate signal SC and the second gate signal SS may be deactivated.

FIG. 3 is a diagram illustrating an embodiment in which the display apparatus 1000 of FIG. 1 is driven in a basic frame period BF.

Figure 4:
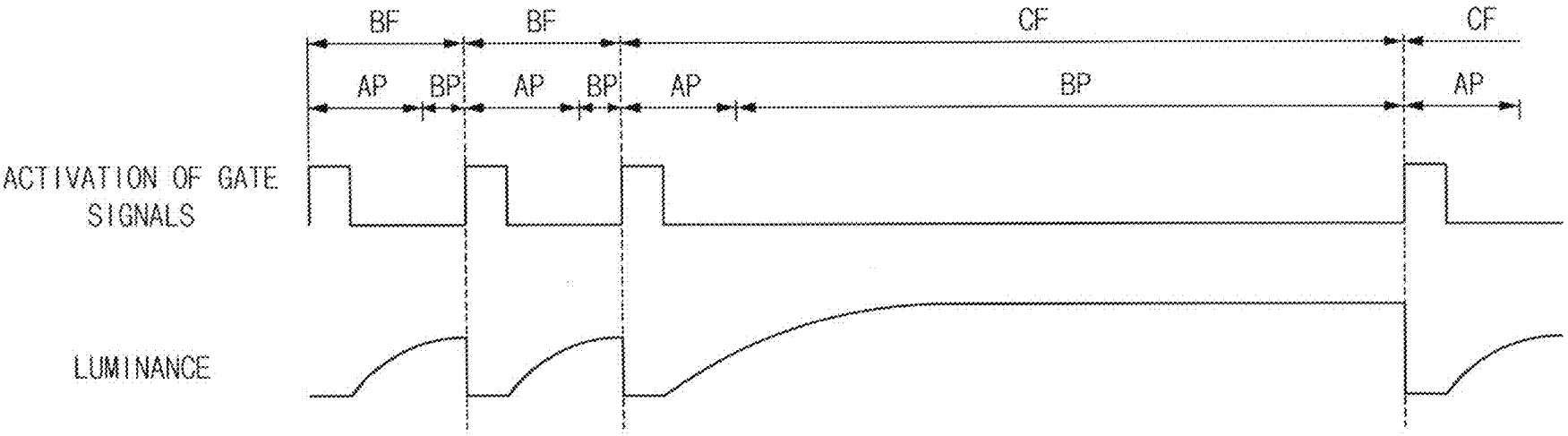
FIG. 4 is a diagram illustrating an embodiment in which a conventional display apparatus is driven without leakage of a driving current.

FIG. 4 is a diagram illustrating an embodiment in which a conventional display apparatus is driven without leakage of a driving current DC.

Referring to FIGS. 3 and 4, activation of the gate signals SC and SS may start within the active period AP. Activation of the gate signals SC and SS may not start within the blank period BP. The gate signals SC and SS may be activated at different times from each other in the active period AP for each gate lines GL.

The length of the blank period BP may be changed to match a frame frequency of a rendering performed by the host processor (e.g. graphic processing unit "GPU") and a frame frequency of the display apparatus 1000 (see in FIG. 1). A frame in the basic frame period BF may be a frame in which the length of the blank period BP is not changed to match the frame frequency of rendering by the host processor and the frame frequency of the display apparatus 1000. A frame in variable frame period CF may be a frame in which the length of the blank period BP is changed to match the frame frequency of rendering by the host processor and the frame frequency of the display apparatus 1000.

While the gate signals SC and SS are activated, the light emitting element EL (see in FIG. 2) may not emit light because the second electrode N2 (see in FIG. 2) is maintained at the initialization voltage Vinit (see in FIG. 2). While the gate signals SC and SS are inactive, a luminance may increase until a saturation state is reached. The light emitting element EL may include an internal capacitor component. The saturation state means a state in which the light emitting element EL is fully charged. When the light emitting element EL reaches the saturation state, the luminance may be practically constant. When a low grayscale image is displayed on the display panel 100 (see in FIG. 1), the time for the light emitting element EL to reach a saturation state may be relatively slower than when a middle grayscale or high grayscale image is displayed. When the length of the blank period BP in a specific frame is not long enough or less than a predetermined period, the luminance may not reach the saturation state during the specific frame. In one embodiment, for example, when the blank period BP is longer in the variable frame period CF than the basic frame period BF, the luminance may not reach a luminance of the saturation state in the basic frame period BF, and the luminance may reach the luminance of the saturation state in the variable frame period CF, as shown in FIG. 4. In this case, a luminance difference may occur between the basic frame period BF and the variable frame period CF.

Figure 5:
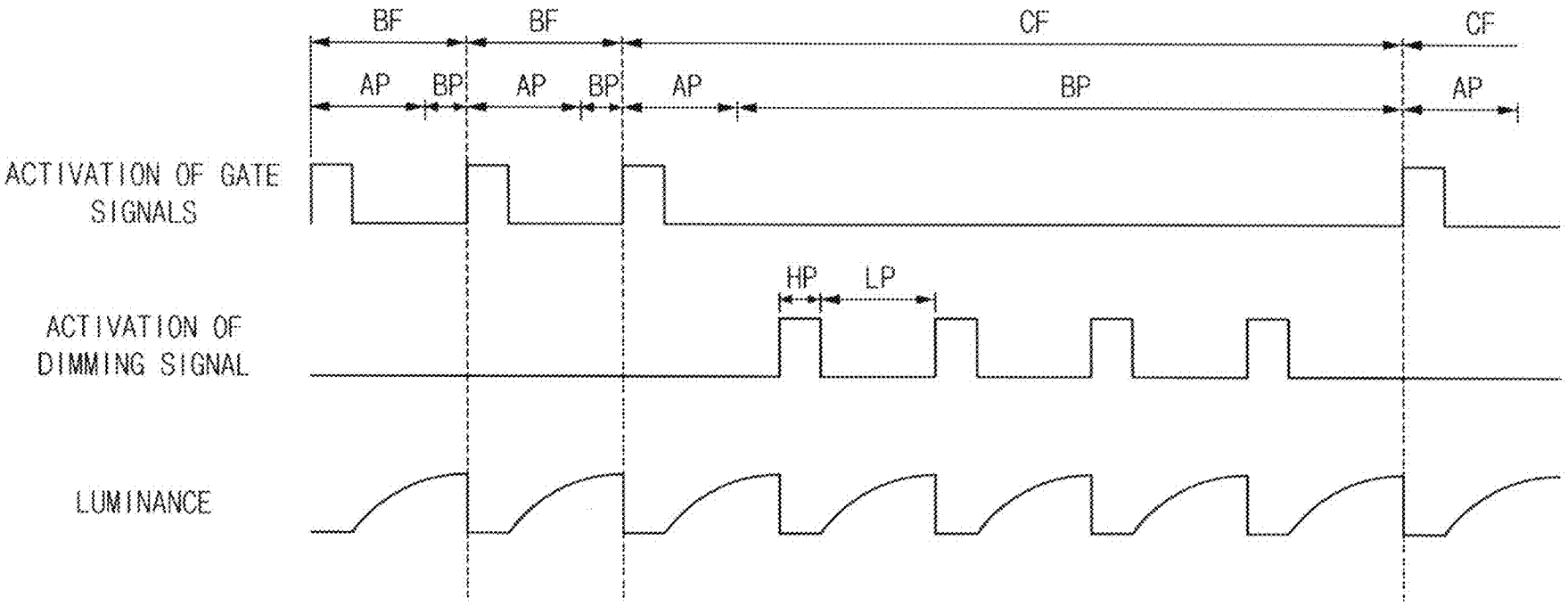
FIG. 5 is a diagram illustrating an embodiment in which the display apparatus is driven.
Figure 6:
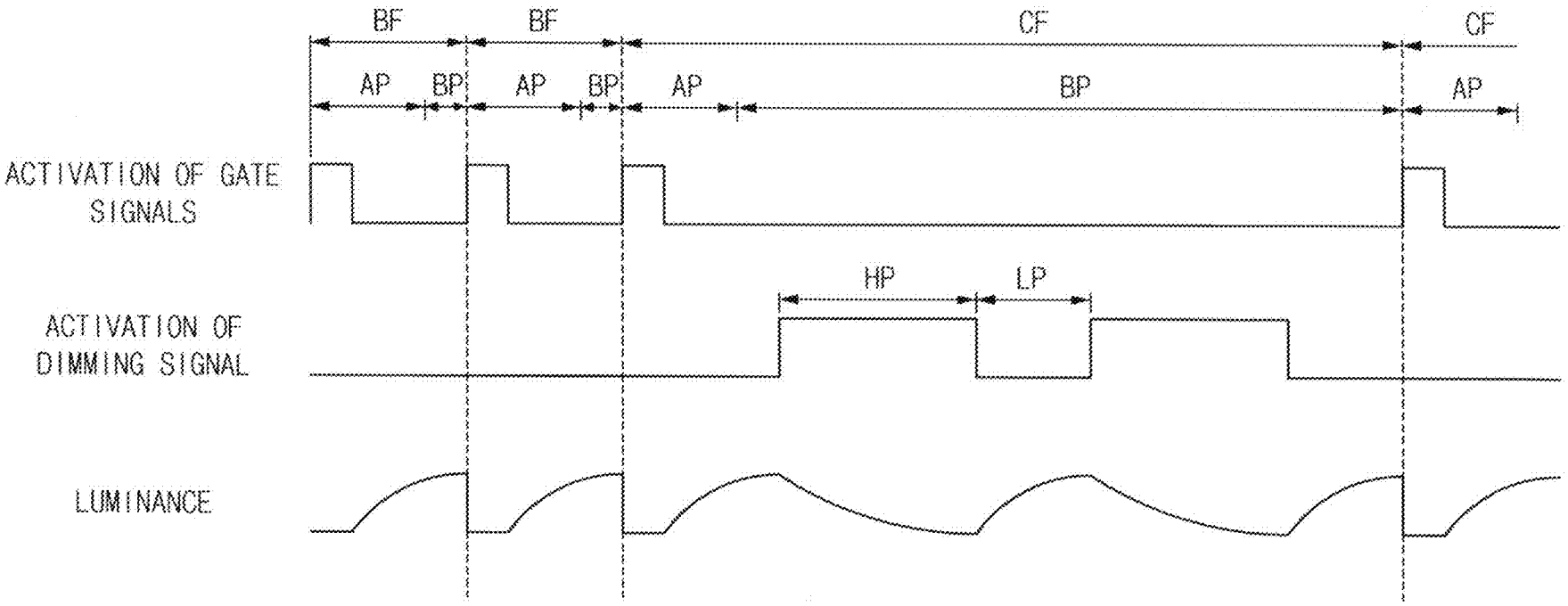
FIG. 6 is a diagram illustrating an embodiment in which the display apparatus is driven.

FIGS. 5 and 6 is a diagram illustrating an embodiment in which the display apparatus 1000 is driven.

Referring to FIG. 5, the dimming signal DIM may not be activated in the basic frame period BF and may be activated in the variable frame period CF. The dimming signal DIM in the variable frame period CF may be activated at a same timing as the gate signal activation timing in the basic frame period BF. Activation of the dimming signal DIM may start within the blank period BP. Activation of the dimming signal DIM may not start within the active period AP.

The dimming signal DIM may not include an activation period HP in the basic frame period BF. The dimming signal DIM may include the activation period HP and a deactivation period LP in the blank period BP of the variable frame period CF. The dimming signal DIM may start the activation period HP only in the blank period BP of the variable frame period CF. In the activation period HP of the dimming signal DIM, the driving current DC may be leaked.

In a case where there is no delay time until the light emitting element EL (see in FIG. 2) emits light in the blank period BP, and all of the driving current DC (see in FIG. 2) instantaneously leak as the leakage current LC (see in FIG. 2) at activation of the dimming signal DIM as shown in FIG. 5, the luminance may increase while the gate signals SC and SS are not activated in the variable frame period CF. In this case, when the dimming signal DIM is activated, all of the driving current DC may leak as the leakage current LC. Accordingly, the luminance may be the same as the luminance while the gate signals SC and SS are activated. When the dimming signal DIM is not activated, the driving current DC may not leak. Accordingly, the luminance may be increased while the dimming signal DIM is not activated or during the deactivation period LP. As a result, the difference of luminance between the basic frame period BF and the variable frame period CF may be reduced than that shown in FIG. 4. In the basic frame period BF, the dimming signal DIM may not be activated. Since the dimming signal DIM in the variable frame period CF is activated depending on the activation timing of the gate signals SC and SS in the basic frame period BF, the luminance in the variable frame period CF may become substantially the same as the luminance in the basic frame period BF.

Referring to FIG. 6, all of the driving current DC (see in FIG. 2) may not instantaneously leak as the leakage current LC (see in FIG. 2) at activation of the dimming signal DIM. In this case, even when the dimming signal DIM is activated, the luminance may gradually decrease. When the leakage current LC is not sufficient, the luminance may not be effectively reduced. In this case, the luminance may be effectively reduced by increasing the length of the activation period HP. The length of the activation period HP of the dimming signal DIM may be determined depending on a characteristic of the pixel P (see in FIG. 1). In an embodiment, the characteristic of the pixel P include the magnitude of the leakage current LC of the pixel P, the luminance change the characteristic of the pixel P due to the leakage current LC, and an exothermic characteristic of the pixel P and the like. In one embodiment, for example, under a condition of applying the same data voltage DV, the same gate signals SS and SC, the same power voltage ELVDD and ELVSS (see in FIG. 2), and the same dimming signal DIM, in the case of the pixel P with a relatively large change in the luminance due to the leakage current LC, the magnitude of the leakage current LC may be reduced and the length of the activation period HP may be increased. In one embodiment, for example, if a heat problem is occurred due to the leakage current LC, the size of the leakage current LC may be reduced and the length of the activation period HP may be increased. In one embodiment, for example, under a condition of applying the same data voltage DV, the same gate signals SS and SC, the same power voltages ELVDD and ELVSS, and the same dimming signal DIM, in the case of the pixel P with a relatively small leakage current LC, the length of the activation period HP may be increased.

In an embodiment of the pixel P (see in FIG. 1), the sum of the turn-on resistance of the fourth transistor T4 (see in FIG. 2) and the fixed resistance of the resistance element R (see in FIG. 2) may be greater than the saturation resistance of the light emitting element EL (see in FIG. 2). The saturation resistance may mean a resistance in a period in which the current flowing through the light emitting element EL linearly increases depending on a voltage applied to the light emitting element EL when a predetermined voltage or greater voltage is applied to the light emitting element EL. The period in which the current of the light emitting element EL linearly increases depending on the voltage applied to the light emitting element EL may be linearly increased. The light emitting element EL may have the saturation resistance in the saturation state when the display apparatus 1000 (see in FIG. 1) displays high grayscale image. The light emitting element EL may have a resistance greater than the saturation resistance before the period in which the current of the light emitting element EL linearly increases depending on the voltage applied to the light emitting element EL. The light emitting element EL may have a higher resistance as the voltage applied to the light emitting element EL decreases before a period in which the current of the light emitting element EL linearly increases depending on the voltage applied to the light emitting element EL.

When a low grayscale image is displayed on the display panel 100 (see in FIG. 1), the time for the light emitting element EL (see in FIG. 2) to reach the saturation state may be relatively slower than when a middle grayscale or high grayscale image is displayed. When a middle grayscale or high grayscale image is displayed, the saturation state may be sufficiently reached even when the length of the blank period BP is short. Therefore, the difference of luminance between the basic frame period BF and the variable frame period CF may be greater in the low grayscale than in the high grayscale. Therefore, the leakage current LC (see in FIG. 2) is desired to be greater in the low gray scale than in the high gray scale.

In one embodiment, for example, when the sum of the turn-on resistance of the fourth transistor T4 (see in FIG. 2) and the fixed resistance of the resistance element R (see in FIG. 2) is greater than the saturation resistance of the light emitting element EL (see in FIG. 2) and the resistance of the light emitting element EL is the saturation resistance, the residual driving current LDC (see in FIG. 2) may be greater than the leakage current LC (see in FIG. 2). Accordingly, when a high grayscale image is displayed, the driving current DC (see in FIG. 2) may flow more as the residual driving current LDC than the leakage current LC. When a low grayscale image is displayed, the value of the leakage current LC relative to the driving current DC may be greater than when a high grayscale image is displayed. As a result, although it may be difficult to precisely set the leakage current LC for each grayscale, the luminance difference mainly occurring in a low grayscale image may be substantially improved by increasing the value of the leakage current LC relative the driving current DC in the low grayscale image.

Figure 7:
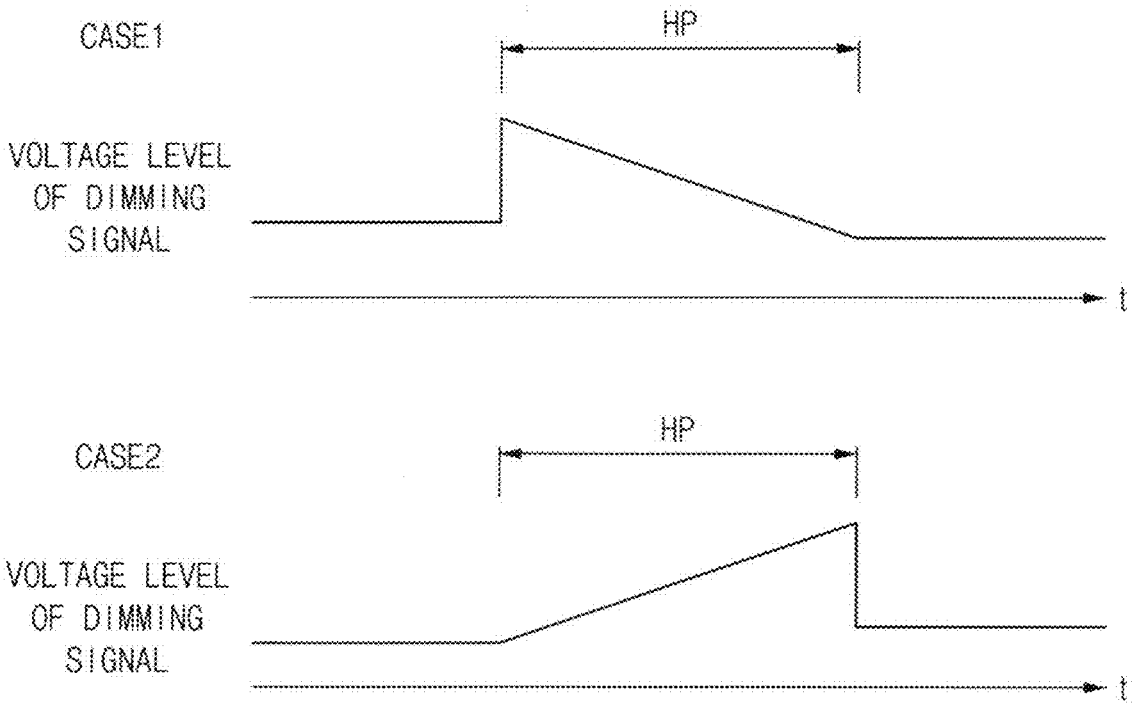
FIG. 7 is a diagram illustrating a dimming signal of a display apparatus according to an embodiment of the invention.

FIG. 7 is a diagram illustrating the dimming signal DIM of the display apparatus according to an embodiment of the invention.

Referring to FIG. 7, in an embodiment, the voltage level of the dimming signal DIM may be gradually changed in the activation period HP. The voltage level of the dimming signal DIM may be decreased with time in the activation period HP (CASE1). The voltage level of the dimming signal DIM may be increased with time in the activation period HP (CASE2). When there is no leakage current LC (see in FIG. 2), the current flowing through the light emitting element EL (see in FIG. 2) is not constant and is increased by the time in which the gate signals SC and SS are not activated. Accordingly, in an embodiment, the display panel driver 200 may gradually change the voltage level of the dimming signal DIM to gradually increase or decrease the leakage current LC.

The turn-on resistance of the fourth transistor T4 (see in FIG. 2) may be changed depending on the voltage level of the dimming signal DIM. Accordingly, the leakage current LC (see in FIG. 2) may be adjusted by adjusting the voltage level of the dimming signal DIM.

Figure 8:
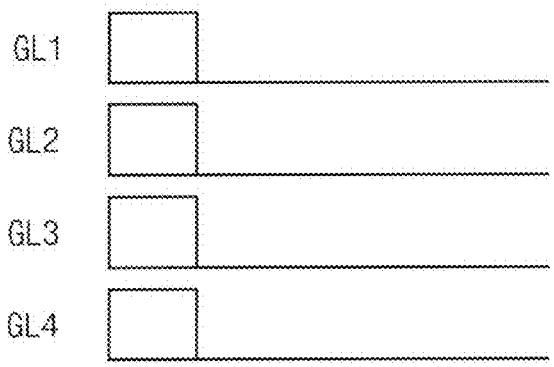
FIG. 8 is a timing diagram illustrating the dimming signal of the display apparatus of FIG. 1.

FIG. 8 is a timing diagram illustrating the dimming signal DIM of the display apparatus of FIG. 1.

Figure 9:
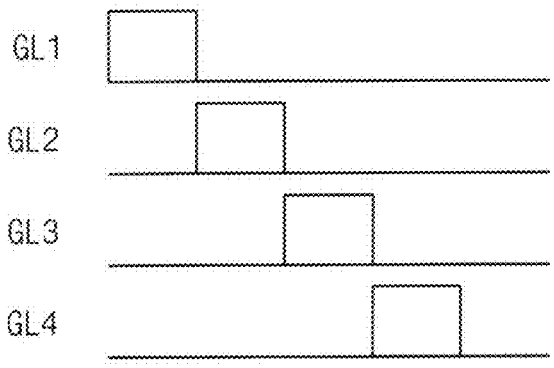
FIG. 9 is a timing diagram illustrating a dimming signal of a display apparatus according to an embodiment of the invention.

FIG. 9 is a timing diagram illustrating a dimming signal DIM of a display apparatus according to an embodiment of the invention.

Referring to FIG. 8, the display panel driver 200 (see in FIG. 1) may simultaneously apply the dimming signal DIM (see in FIG. 2) to all of the pixels P (see in FIG. 1). In one embodiment, for example, the dimming signal DIM may be simultaneously applied to all the gate lines GL1, GL2, GL3, GL4 . . . .

Referring to FIG. 9, the display panel driver 200 (see in FIG. 1) may sequentially apply the dimming signal DIM (see in FIG. 2) to the pixels P (see in FIG. 1) on a row-by-row basis. One row may mean one gate line GL. In one embodiment, for example, after the dimming signal DIM is applied to a first gate line GL1, the dimming signal DIM may be applied to a second gate line GL2. In such an embodiment, after the dimming signal DIM is applied to the second gate line GL2, the dimming signal DIM may be applied to a third gate line GL3. In such an embodiment, after the dimming signal DIM is applied to the third gate line GL3, the dimming signal DIM may be applied to a fourth gate line GL4. However, application sequence of the dimming signal DIM is not limited thereto.

According to an embodiment, since the data voltage DV (see in FIG. 2) and the gate signals SC and SS (see in FIG. 2) are not simultaneously applied to all the gate lines GL, the time point at which the luminance starts to increase is different for each gate lines GL. Since the timing at which the dimming signal DIM (see in FIG. 2) is applied to each of the gate lines GL is different for each gate lines GL, the luminance difference between the basic frame period BF and the variable frame period CF is appropriately improved for each gate lines GL.

Embodiments of the invention may be applied any electronic device including the display apparatus that changes the frame frequency by changing the blank period. In one embodiment, for example, the inventions may be applied to a television ("TV"), a digital TV, a three-dimensional ("3D") TV, a mobile phone, a smart phone, a tablet computer, a virtual reality ("VR") device, a wearable electronic device, a personal computer ("PC"), a home appliance, a laptop computer, a personal digital assistant ("PDA"), a portable multimedia player ("PMP"), a digital camera, a music player, a portable game console, a navigation device, etc.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A pixel comprising:

a capacitor including a first electrode and a second electrode;

a first transistor which generates a driving current;

a second transistor which applies a data voltage to the first electrode of the capacitor;

a third transistor which applies an initialization voltage to the second electrode of the capacitor;

a fourth transistor which generates a leakage current in response to a dimming signal;

a light emitting element which emits light based on a residual driving current, wherein the residual driving current is obtained by subtracting the leakage current from the driving current; and a resistance element connected to the fourth transistor and having a fixed resistance.

2. The pixel of claim 1, wherein a sum of a turn-on resistance of the fourth transistor and the fixed resistance of the resistance element is greater than a saturation resistance of the light emitting element.

3. The pixel of claim 1, wherein the dimming signal is not activated in a basic frame period, and the dimming signal is activated in a variable frame period.

4. The pixel of claim 3, wherein the dimming signal in the variable frame period is activated at a same timing as an activation timing of a gate signal in the basic frame period.

5. The pixel of claim 4, wherein an activation of the dimming signal is started in a blank period of the variable frame period.

6. The pixel of claim 1, wherein a length of an activation period of the dimming signal is determined by a characteristic of the pixel.

7. The pixel of claim 1, wherein a voltage level of the dimming signal is changed over a period of time during an activation period of the dimming signal.

8. The pixel of claim 7, wherein the voltage level of the dimming signal is increased with time during the activation period of the dimming signal.

9. A display apparatus comprising:

a display panel including a plurality of pixels; and a display panel driver which applies a gate signal and a dimming signal to the pixels, wherein each of the pixels comprises:

a capacitor including a first electrode and a second electrode;

a first transistor which generates a driving current;

a second transistor which applies a data voltage to the first electrode of the capacitor;

a third transistor which applies an initialization voltage to the second electrode of the capacitor;

a fourth transistor which generates a leakage current in response to the dimming signal; and a light emitting element which emit light based on a residual driving current, wherein the residual driving current is obtained by subtracting the leakage current from the driving current, wherein each of the pixels further comprises a resistance element connected to the fourth transistor and having a fixed resistance.

10. The display apparatus of claim 9, wherein a sum of a turn-on resistance of the fourth transistor and the fixed resistance of the resistance element is greater than a saturation resistance of the light emitting element.

11. The display apparatus of claim 9, wherein the dimming signal is not activated in a basic frame period, and the dimming signal is activated in a variable frame period.

12. The display apparatus of claim 11, wherein the dimming signal in the variable frame period is activated at a same timing as an activation timing of the gate signal in the basic frame period.

13. The display apparatus of claim 12, wherein an activation of the dimming signal is started in a blank period of the variable frame period.

14. The display apparatus of claim 9, wherein a length of an activation period of the dimming signal is determined by characteristic of the pixels.

15. The display apparatus of claim 9, wherein a voltage level of the dimming signal is changed over a period of time during an activation period of the dimming signal.

16. The display apparatus of claim 15, wherein the voltage level of the dimming signal is increased with time during the activation period of the dimming signal.

17. The display apparatus of claim 9, wherein the display panel driver sequentially applies the dimming signal to the pixels on a row-by-row basis.

18. The display apparatus of claim 9, wherein the display panel driver simultaneously applies the dimming signal to all of the pixels.

* * * * *